United States Patent [19]

Karasawa et al.

[11] Patent Number: 4,772,918

[45] Date of Patent: Sep. 20, 1988

[54] CURRENT-CONTROLLED IMAGE TRANSFER

[75] Inventors: Kazunori Karasawa; Mitsuo Hasebe, both of Tokyo, Japan

[73] Assignee: Ricoh Company, Ltd., Tokyo, Japan

[21] Appl. No.: 750,938

[22] Filed: Jul. 1, 1985

[30] Foreign Application Priority Data

Jun. 30, 1984 [JP] Japan ..... 59-134066

[51] Int. Cl.[4] ..... G03G 15/14

[52] U.S. Cl. ..... 355/14 TR; 355/3 TR; 355/14 CH

[58] Field of Search ..... 355/3 BE, 3 TR, 14 TR, 355/14 CH

[56] References Cited

U.S. PATENT DOCUMENTS

| | | | |
|---|---|---|---|
| 3,694,068 | 9/1972 | Jordon | 355/3 BE |
| 3,788,739 | 1/1974 | Coriale | 355/3 R X |
| 4,134,147 | 1/1979 | Watanabe | 355/14 TR X |
| 4,341,457 | 7/1982 | Nakahata et al. | 355/3 TR X |
| 4,401,383 | 8/1983 | Suzuki et al. | 355/14 TR X |
| 4,415,254 | 11/1983 | Nishikawa | 355/14 TR X |
| 4,536,082 | 8/1985 | Motohashi et al. | 355/3 TR X |

*Primary Examiner*—Fred L. Braun

*Attorney, Agent, or Firm*—Oblon, Fisher, Spivak, McClelland & Maier

[57] ABSTRACT

An image transfer system includes an image bearing member made of a photoconductive layer and an electrically conductive backing layer, a current detector connected between the backing layer and ground, a transfer corona unit for applying corona ions to a back side of a transfer sheet brought into contact with the exposed surface of the photoconductive layer on which a toner image is carried, a power supply for applying power to the corona unit, and a controller for controlling the power supply in response to a current level detected by the current detector. This system maintains the image transfer efficiency substantially at a constant level irrespective of the condition of transfer sheet used, and in particular to the water content of the sheet.

3 Claims, 2 Drawing Sheets

CURRENT-CONTROLLED IMAGE TRANSFER

BACKGROUND OF THE INVENTION

1. Field of the Invention

The present invention generally relates to an image transfer system, and in particular, to a system for transferring a toner image formed on an imaging member to a transfer medium for use in an imaging machine, such as an electrophotographic copier, facsimile machine or laser beam printer.

2. Description of the Prior Art

An electrophotographic imaging machine, such as an electrophotographic copier, is well known in the art. Such an electrophotographic imaging machine includes a photosensitive member typically comprised of a base of electrically conductive material and a photoconductive layer formed on the base. The photosensitive member is first charged uniformly by a corona charger, and then the thus charged photosensitive member is exposed to an original light image thereby forming an electrostatic latent image by having the uniform charge selectively dissipated in accordance with the original light image. The latent image thus formed is then developed, typically by toner, so that there is formed a powder visual image on the photosensitive member. Then, the powder image is transferred to a transfer medium, typically plain paper, by means of a transfer corona unit. In this case, the transfer medium is brought into contact with the surface of the photosensitive member on which the powder image is formed, and corona ions opposite in polarity to the toner powder are applied to the back side of the transfer medium thereby causing the powder image to be electrostatically attracted to the transfer medium from the photosensitive member. The transfer medium now bearing thereon the thus transferred image is typically subjected to an image fixing operation, for example, by application of heat to have the transferred image fixed to the transfer medium. On the other hand, after image transfer, the photosensitive member is cleaned to remove the residual toner thereby setting ready for the next cycle of operation.

In such an electrophotographic imaging machine, the electrically conductive base of the photosensitive member is grounded, and, thus, when the corona ions of a predetermined polarity are applied to the exposed surface of the photoconductive layer, charges of opposite polarity are induced in the base to maintain the charge neutrality. Thus, when corona ions are applied at the image transfer station to the back side of the transfer medium in contact with the photosensitive member, charges of opposite polarity are also induced in the base of the photosensitive member. In such a corona image transfer system, the transfer efficiency of toner powder fluctuates depending on the humidity, or the amount of water contents in the transfer medium. That is, if the humidity is high, the transfer medium contains more water so that its electrical resistance is effectively decreased, and, thus, the charges applied to the back side of the transfer medium from a corona unit will pass more through the transfer medium thereby leaking to the side of the photosensitive member. This will cause a deterioration in transfer efficiency and thus in the quality of transferred image.

SUMMARY OF THE INVENTION

In accordance with the principle of the present invention, there is provided an image transfer system for transferring a toner image formed on an image bearing member to a transfer medium in which a current detector is provided as connected between an electrically conductive portion of the image bearing member and a reference potential, such as ground, so as to monitor the corona current and a controller connected to an image transfer corona unit controls the corona current responsive to a detection signal from the current detector. With such a structure, the transfer efficiency in transferring the toner image from the image bearing member to the transfer medium may be maintained at constant irrespective of the humidity of the environment or the amount of water contents in the transfer medium. In addition, such an image transfer system is also advantageous in detecting the possible occurrence of jamming of transfer medium and of simultaneous feeding of multiple transfer mediums.

It is therefore a primary object of the present invention to provide an improved image transfer system high in image transfer operation irrespective of the humidity condition.

Another object of the present invention is to provide an improved image transfer system suitable for use in an electrophotographic imaging machine, such as an electrophotographic copier.

A further object of the present invention is to provide an improved image transfer system capable of detecting the possible occurrence of paper jamming and of simultaneous feeding of multiple transfer sheets.

Other objects, advantages and novel features of the present invention will become apparent from the following detailed description of the invention when considered in conjunction with the accompanying drawings.

DESCRIPTION OF THE PREFERRED EMBODIMENTS

Figure 1:
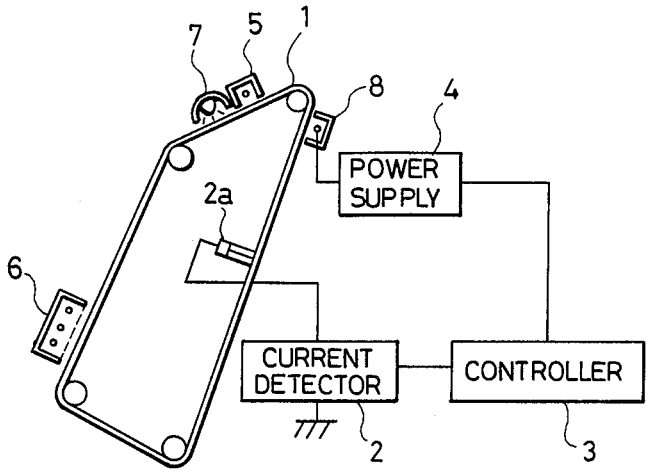
FIG. 1 is a schematic illustration showing an electrophotographic imaging system to which the present invention has been suitably applied.

Referring now to FIG. 1, there is schematically shown an electrophotographic imaging system to which the present invention has been advantageously applied. As shown, the system includes a photosensitive member 1 in the form of an endless belt, which is typically comprised of an electrically conductive base and a photoconductive layer formed on the base. The belt-shaped photosensitive member 1 is extended around a plurality of rollers at least one of which is driven to rotate by a driving motor (not shown) to cause the belt-shaped photosensitive member 1 to advance in a predetermined direction at constant speed. It should be understood that the photosensitive belt 1 is so arranged with its electrically conductive base located at the inner side and the photocondutive layer at the outside. It should also be noted that the rollers in contact with the base of the belt 1 are all electrically floating. As is well known in the art, along the outer surface of the photosensitive belt 1, which is the exposed surface of the photoconductive layer and defines an imaging surface for forming thereon an image, there are disposed various types of components necessary for electrophotographic processing. However, for the sake of brevity, only corona units 5, 6 and 8 and an erasure lamp 7 are shown in FIG. 1.

As the photosensitive belt 1 advances counterclockwise in FIG. 1, its outer surface is uniformly charged by the corona unit 6. Then, the uniform charge on the belt 1 is exposed to an original light image at an exposure station (not shown) downstream of the corona unit 6 where the uniform charge is selectively dissipated in accordance with a light pattern of the original thereby forming an electrostatic latent image. Then, as the photosensitive belt 1 further advances, the electrostatic latent image thus formed is brought to a developing station (not shown) where the latent image is developed, typically, with toner powder thereby converting the latent image into a toner powder image. Then, the toner power image is brought into an image transfer station where the corona unit 8 is disposed. At the image transfer station, a transfer medium, typically plain paper, is brought into contact with the outer surface of the photosensitive belt 1 with the toner image sandwiched therebetween, and corona ions opposite in polarity to the toner image is applied to the back side of the transfer medium so that the toner image on the photosensitive belt 1 is now transferred onto the transfer medium as the transfer medium in contact with the photosensitive belt 1 moves past the transfer corona unit 8.

Thereafter, the transfer medium now bearing thereon the toner image is separated away from the photosensitive belt 1 and guided through an image fixing station (not shown) where the toner image is permanently fixed to the transfer medium as well known in the art. On the other hand, the photosensitive belt 1 is further advanced to move past a composite unit comprised of corona unit 5 and lamp 7 for removing the remaining charge on the photosensitive belt 1. Typically, a cleaning station (not shown) is defined downstream of this composite unit for removing any residual toner on the photosensitive belt 1 for preparing the photosensitive belt 1 ready for the next cycle of operation.

In accordance with the principle of the present invention, there is also provided a current detector 2 which is connected between an electrically conductive brush 2*a* and ground as shown. The brush 2*a* is in electrical contact with the electrically conductive base of the photosensitive belt 1 which is electrically floating. Thus, the electrical current flowing between the base of the photosensitive belt 1 and ground always passes through the current detector 2 so that the level of such current can be monitored. The current detector 2 is also connected to a controller 3 which is preferably comprised of a central processing unit, so that information as to the level of current flowing between the photosensitive belt 1 and ground may be supplied to the controller 3. On the other hand, the controller 3 is also connected to a power supply unit 4 which is connected to the corona wire of the transfer corona unit 8. Thus, the controller 3 supplies a control signal to the power supply 4 in accordance with the current level information supplied from the current detector 2.

Figure 2:
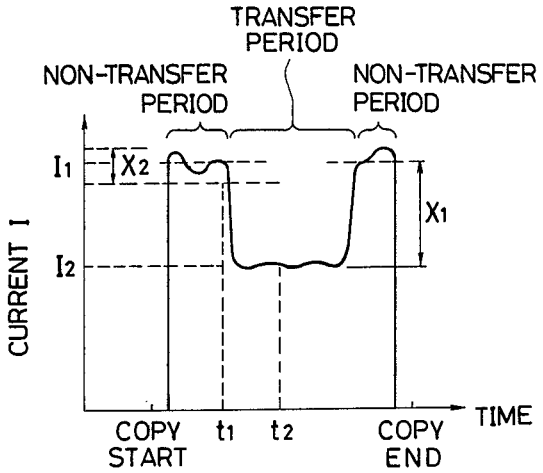
FIG. 2 is a graph illustrating how the corona current changes with time during an ordinary reproduction process.

The typical variation of current detected by the current detector 2 is graphically shown in FIG. 2 whose ordinate indicates current level detected by the current detector 2 and whose abscissa indicates time. As shown in FIG. 2, when a short period of time has elapsed after initiation of copy operation, for example, by depression of copy button, each of the corona units, such as 5, 6 and 8 shown in FIG. 1, is turned on so that they start to emit corona ions. When corona ions are deposited onto the outer surface of the photosensitive belt 1, the counter charge is introduced into the base of the photosensitive belt 1 from ground through the current detector 2. The current level passing through the current detector 2 significantly differs between a time when a transfer medium is passing below the transfer corona unit 8 and a time when no transfer medium is passing below the transfer corona unit 8. The current level is significantly lowered while such a transfer medium is passing through the transfer station or below the transfer corona unit 8 because a substantial amount of corona current from the transfer corona unit 8 is blocked by the transfer medium. Therefore, there is produced a current difference x between a non-transfer period, in which no transfer medium is present below the transfer corona unit 8, and a transfer period, in which a transfer medium is present below the transfer corona unit 8. In other words, this differential current x indicates the amount of charge used for carrying out image transfer from the photosensitive belt 1 to the transfer medium. As a result, this differential current x is closely related to an image transfer efficiency from the photosensitive belt 1 to the transfer medium. Stated differently, the image transfer efficiency can be maintained at constant if this differential current x is maintained at constant.

As shown in FIG. 2, a representative current level for the non-transfer period is designated by $I_1$ and a representative current level for the transfer period is designated by $I_2$. Such a representative current level, corresponding time period or may be an instantaneous current level at a particular point in time during the corresponding time period. A differential current x is a difference between these representative current levels $I_1$ and $I_2$. And, the particular differential current $x_1$ is an intended current difference in order to attain a particular transfer efficiency. In accordance with the present invention, the controller 3 controls the power supply 4 such that the differential current x between the representative current levels $I_1$ and $I_2$ is always maintained in the vicinity of the intended value $x_1$ so as to maintain the image transfer efficiency substantially at constant. It should further be noted that if a transfer sheet of paper has failed to reach the image transfer station due to paper jamming, the differential current $x=I_1-I_2$ remains substantially small and this fact can be used to detect the possible occurrence of paper jamming.

Figure 3:
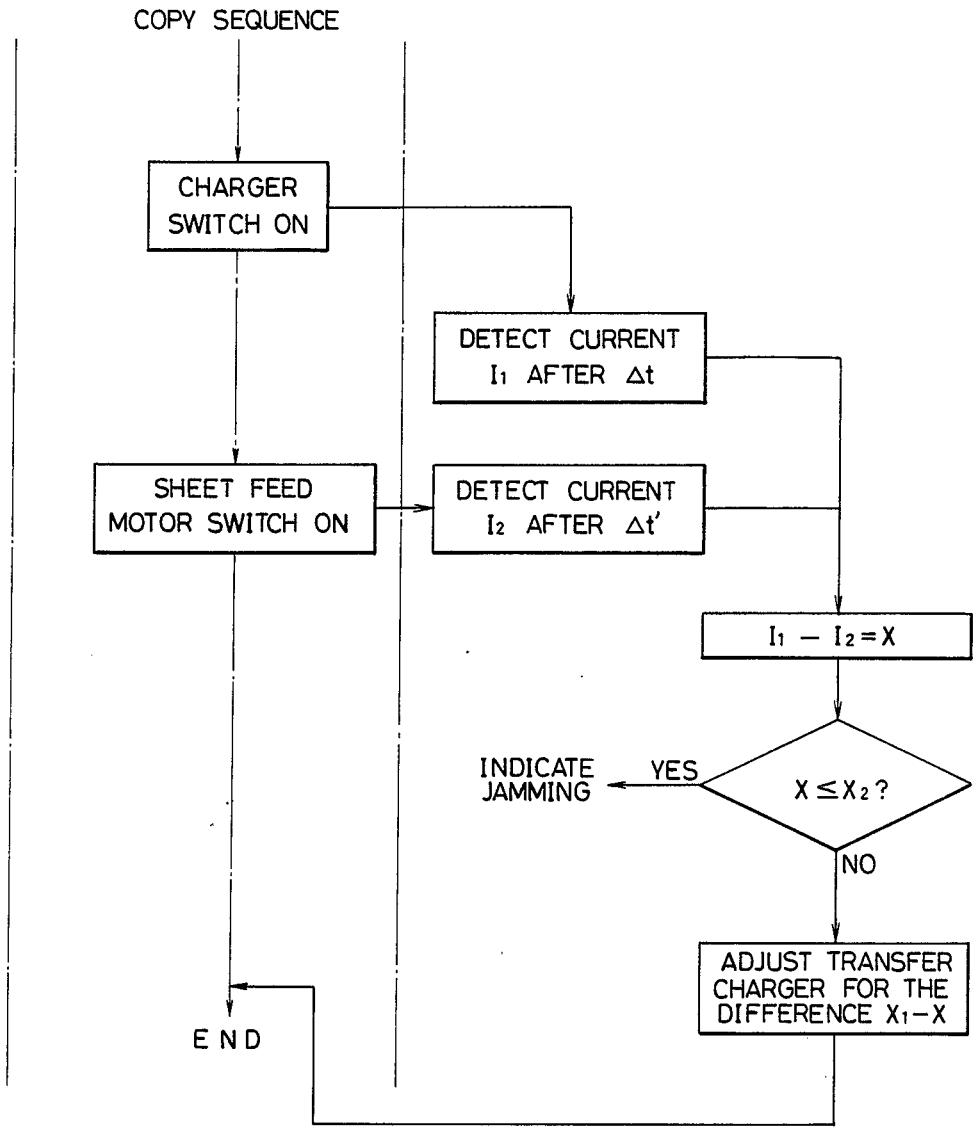
FIG. 3 is a flow chart which is useful for explaining the principle of the present invention.

Now the operation of the system shown in FIG. 1 will be described with particular reference to FIG. 3. When the copy button is depressed to initiate a sequence of copying operation, the photosensitive belt 1 is set in motion and shortly thereafter the corona units 5, 6 and 8 are turned on. When a short period of time (delta t) has elapsed after turning on of the corona units, the current level $I_1$ is detected by the current detector 2 and this information is stored into a memory area of the controller 3. This time period (delta t) may be set arbitrarily as long as a representative current level can be measured during the non-transfer period. Thereafter, a paper feed motor (not shown) is turned on so that a transfer sheet of paper is supplied toward the transfer station. Here, a time period required for the transfer sheet of paper to reach the transfer station to be located below the transfer corona unit 8 from its storing section will be defined as delta t'. Thus, after elapsing time period delta t' since turning on of the paper feed motor, the representative current level $I_2$ during the transfer period is measured an this information is also stored into the memory of the controller 3.

With information of $I_1$ and $I_2$ stored as described above, the controller 3 now executes the calculation of $I_1-I_2=x$. Then, if the thus obtained x is smaller than a predetermined value $x_2$, the controller 3 determines the occurrence of paper jamming and thus brings the entire system to a halt with issuance of a warning signal to that effect. It is to be noted that this predetermined value $x_2$ is preferably so determined that it is larger than the current fluctuation level during a normal non-transfer period but is smaller than a reduction of current caused by a transfer sheet blocking the corona current from the transfer corona unit 8. On the other hand, if the calculated x is larger than $x_2$, then a calculation of $x_1-x$ is carried out and the controller 3 supplies a control signal to the power supply 4 so as to make $x_1-x$ to be equal to zero. In this manner, in accordance with the present invention, the current difference x between the transfer and non-transfer periods can be always maintained at the intended value $x_1$ so that the image transfer efficiency can be maintained substantially at constant at all times irrespective of the condition of the transfer sheet, in particular its amount of water contents.

It should further be noted that the principle of the present invention may also be used for detecting the possible occurrence of simultaneous feeding of multiple transfer sheets. That is, if two or more transfer sheets are supplied at the same time with one on top of another, the electrostatic capacitance defined by the photosensitive belt 1 and the overlaid multiple transfer sheets is decreased so that the current level becomes significantly lowered as compared with an ordinary situation in which a single sheet of transfer sheet is present on the photosensitive belt 1. Thus, if another predetermined current reduction $x_3$ which is produced when two or more transfer sheets are fed at the same time as stacked one on another in the controller 3, the possible occurrence of simultaneous multiple feeding can be detected. In this case, if the controller 3 finds that x is larger than $x_3$, it issues a signal indicating the occurrence of simultaneous multiple feeding.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. An image transfer system comprising:

image bearing means having an electrically conductive base and an imaging surface for bearing thereon a toner image of first polarity;

current detecting means connected between said electrically conductive base of said image bearing means and a reference potential;

corona unit for applying corona ions of second polarity opposite to said first polarity to the back side of a transfer medium which is brought into contact with said imaging surface of said image bearing means for transferring said toner image from said image bearing means to said transfer medium;

a power supply connected to said corona unit for supplying a power thereto for emitting said corona ions; and control means for controlling a power level to be applied to said corona unit from said power supply responsive to information supplied from said current detecting means, said control means measuring a first current level $I_1$ during a non-transfer period, in which no transfer sheet is present below said corona unit, and a second current level $I_2$ during a transfer period, in which said transfer sheet is present below said corona unit, and, then, after comparing a difference x between $I_1$ and $I_2$ with a first predetermined value $x_1$ stored in said control means, controlling said power supply so as to make $x-x_1$ to be substantially equal to zero.

2. The system of claim 1 wherein said control means stores a second predetermined value $x_2$ whereby said control means compares x with $x_2$ and issues a first warning signal indicating an occurrence of paper jamming if x is found to be equal to or smaller than $x_2$.

3. The system of claim 1 wherein said control means stores a third predetermined value $x_3$ whereby said control means compares x with $x_3$ and issues a second warning signal indicating an occurrence of simultaneous multiple feeding of transfer sheets if x is found to be equal to or larger than $x_3$.

* * * * *